US007020940B2

(12) United States Patent
Foster

(10) Patent No.: US 7,020,940 B2
(45) Date of Patent: Apr. 4, 2006

(54) TEXTURING YARN

(75) Inventor: Peter William Foster, Alderley Edge (GB)

(73) Assignee: The University of Manchester, Manchester (GB)

( * ) Notice: Subject to any disclaimer, the term of this patent is extended or adjusted under 35 U.S.C. 154(b) by 16 days.

(21) Appl. No.: 10/415,630

(22) PCT Filed: Oct. 29, 2001

(86) PCT No.: PCT/GB01/04771

§ 371 (c)(1),
(2), (4) Date: Apr. 30, 2003

(87) PCT Pub. No.: WO02/36868

PCT Pub. Date: May 10, 2002

(65) Prior Publication Data

US 2004/0040278 A1 Mar. 4, 2004

(51) Int. Cl.
*D02J 1/08* (2006.01)

(52) U.S. Cl. ..... 28/271; 28/276; 57/350; 57/908

(58) Field of Classification Search ..... 28/271–276, 28/282, 283, 267, 258, 247, 248, 250, 252, 28/220, 254–256, 219; 57/289, 403, 333, 57/350, 908, 351

See application file for complete search history.

(56) References Cited

U.S. PATENT DOCUMENTS

| | | | | | |
|---|---|---|---|---|---|
| 3,407,583 | A | * | 10/1968 | Irwin et al. | 57/22 |
| 4,007,580 | A | * | 2/1977 | Nijhuis | 57/257 |
| 4,051,660 | A | * | 10/1977 | Griset, Jr. | 57/205 |
| 4,064,684 | A | * | 12/1977 | Nijhuis | 57/296 |
| 4,096,611 | A | * | 6/1978 | Heyner | 28/220 |
| 4,100,725 | A | * | 7/1978 | Magel | 57/206 |
| 4,141,122 | A | | 2/1979 | Trifunovic | |
| 4,417,375 | A | * | 11/1983 | Sano et al. | 28/272 |
| 4,437,302 | A | | 3/1984 | Anahara et al. | |
| 4,575,999 | A | | 3/1986 | Anahara et al. | |
| 5,193,335 | A | | 3/1993 | Mori | |
| 5,640,745 | A | * | 6/1997 | Bertsch et al. | 28/252 |
| 5,931,972 | A | * | 8/1999 | Foster et al. | 8/151.2 |
| 6,397,444 | B1 | * | 6/2002 | Foster et al. | 28/271 |
| 6,438,934 | B1 | * | 8/2002 | Foster et al. | 57/328 |
| 6,513,315 | B1 | * | 2/2003 | Alavoine et al. | 57/286 |
| 6,701,704 | B1 | * | 3/2004 | Foster et al. | 57/333 |

FOREIGN PATENT DOCUMENTS

| | | |
|---|---|---|
| GB | 842762 | 7/1960 |
| WO | WO 01/04396 A1 | 1/2001 |

OTHER PUBLICATIONS

International Search Report for PCT/GB01/04771 filed Oct. 29, 2001, mailed Apr. 9, 2002.

* cited by examiner

*Primary Examiner*—A. Vanatta
(74) *Attorney, Agent, or Firm*—Wallenstein Wagner & Rockey, Ltd.

(57) ABSTRACT

There is disclosed a method of texturing yarn products wherein the yarn product is passed along a predetermined yarn path through a liquid jet device applying a force to the yarn transversely to the axis thereof, comprising directing the liquid as it passes through the liquid jet device past an air inlet to the liquid jet device to entrain air therein.

59 Claims, 3 Drawing Sheets

TEXTURING YARN

This Application is a continuation of International Application No. PCT/GB01/04771, with an international filing date of 29 Oct. 2001, now pending, claiming priority from Great Britain Application No. GB00/26763.3, filed 2 Nov. 2000, now pending, and herein incorporated by reference.

TECHNICAL FIELD

This invention relates to the texturing of textile yarn products, in particular the jet texturing of filament and/or staple yarns, which includes the intermingling and/or the twisting of multifilament yarns, the co-mingling of two or more filament yarns and the combining of filament and staple yarns.

BACKGROUND OF THE INVENTION

It is known to perform the above processes on one or more textile yarns by passing the yarn or yarns through a jet device in which a jet or jets of air are directed transversely of the travelling yarn or yarns to agitate or twist the filaments or the fibres of the yarns. Agitation by such means may cause uniform texturing or intermittent texturing, i.e. intermingling or co-mingling. When intermittent, nips are produced in the yarn or yarns at spaced intervals. Since such jets rely on air turbulence, the degree of twist, texturing or of nip spacing along the yarn is in consequence random. Whilst the average degree of twist, texturing or nip production per unit length of yarn processed by such known jets may be satisfactory for certain textile applications, there are often long lengths of yarn produced having no twist, texture or nips. These lengths of yarn when used in knitted or woven fabrics manifest themselves as unsatisfactory regions in the fabric. To remove spin finish oil and to improve process stability it is known to wet the yarn prior to its entry into the air jet, but the above problems still exist. In addition, typically a machine for performing such processes can have many, for example 200 or more, processing positions, i.e. 200 or more yarns are processed simultaneously in parallel threadlines. The provision of high pressure air to such numbers of jets is expensive and such a machine is very noisy.

SUMMARY OF THE INVENTION

To overcome the above problems, in our co-pending International Application No PCT/GB00/02610 there is proposed a method of texturing textile yarn products comprising passing the yarn product along a predetermined yarn path through a liquid jet device applying a force to the yarn transversely to the axis thereof. It has now been found that, surprisingly, the performance of the method proposed in that application and the quality of the products produced thereby can be improved by modifying the liquid flow through the jet device.

The invention provides a method of texturing textile yarn products wherein the yarn product is passed along a predetermined yarn path through a liquid jet device applying a force to the yarn transversely to the axis thereof, comprising directing the liquid as it passes through the liquid jet device past an air inlet to the liquid jet device to entrain air therein.

The force may be applied to the yarn by the liquid prior to passing the liquid past the air inlet. Alternatively, the force may be applied to the yarn by the liquid simultaneously with passing the liquid past the air inlet.

The method may also comprise applying a forwarding force or a retarding force to the yarn product. The method may comprise applying at least one jet of liquid to the surface of the yarn product transversely to the axis thereof, and may comprise applying the at least one jet of liquid with components of velocity both axially of and transversely to the yarn path through the jet device. The method may comprise applying a plurality of jets of liquid disposed about the axis of the yarn path through the jet device. The method may comprise applying the plurality of jets of liquid offset from the axis of the yarn path to twist the yarn. Preferably the liquid is water and may be cold water. The supply of water may be pulsed. The method may comprise directing the air entrained along the air inlet transversely to the axis of the direction of flow of liquid through the jet device, and may comprise directing the air entrained along the air inlet with components of velocity both axially of and transversely to the flow of liquid through the jet device.

The yarn product may be a plurality of yarns that are combined to form a single coherent yarn. One of the yarns may be a staple yarn. Alternatively, the yarn product may be continuous filaments.

The invention also provides a process in which the yarn product is textured by the above method, and the process may comprise drawing the yarn product to form a partially oriented yarn.

The process may be controlled by a feedback arrangement. In this case a property of the yarn product may be measured and the measurement used to control the process. The measurement may be used to control the liquid jet device or a yarn product speed. The yarn product may be wound up after being textured.

The process may also include cooling the yarn product. The yarn may be cooled by the liquid jet device. The process may comprise heating the yarn, and may comprise twisting the yarn. The yarn product may also be cooled in a liquid immersion cooling zone, in which case a cooling liquid may be moved in contraflow to the yarn product passing through the cooling zone. The cooling zone and the liquid jet device may be contiguous. The coolant liquid may be the liquid of the jet device.

The invention may also comprise apparatus for texturing a yarn product comprising a liquid jet device adapted to apply to a yarn product travelling along a predetermined yarn path through the jet device a force transversely to the axis of the yarn product, the liquid jet device having a path for the liquid through the liquid jet device and an air inlet communicating with the path for the liquid.

The liquid jet device may be adapted to apply the force to the yarn upstream of the air inlet. Alternatively, the liquid jet device may be adapted to apply the force to the yarn simultaneously with passing the liquid past the air inlet.

The liquid jet device may be adapted to apply a forwarding force or a retarding force to the travelling yarn product. The jet device may apply at least one jet of liquid to the surface of the yarn product transversely to the axis thereof. The at least one jet of liquid may be directed to have velocity components both axially of and transversely to the yarn path through the jet device. A plurality of liquid jets may be disposed about the yarn path through the liquid jet device. The plurality of jets of liquid may be offset from the axis of the yarn path to twist the yarn. The liquid jet device may comprise a housing which terminates in a yarn constricting outlet, having an axis defining a yarn path therethrough, with liquid flow channels aimed towards the outlet and transverse to the axis. The housing may comprise at least one seal against liquid escape along the yarn path. The seal may be a labyrinth seal, which may be pressurised, and may be gas pressurised, e.g. by compressed air. The air inlet may extend transversely to the axis of the direction of flow of liquid through the jet device, and may extend in a direction having components both axially of and transversely to the flow of liquid through the jet device. The liquid jet device may comprise a baffle located at the outlet thereof. Preferably the liquid jet device comprises a water jet device.

The jet device may be arranged in the path of a plurality of yarns. Alternatively, the jet device may be arranged in a filament spinning apparatus. The apparatus may also comprise drawing means, which may be disposed upstream of the jet device. The apparatus may comprise a feedback arrangement operable to control the processing of the yarn product. The feedback arrangement may comprise a measuring instrument operable to measure a property of the yarn product, and control means operable in response to a signal from the measuring instrument proportional to the measurement to control the processing of the yarn product. The control means may be operable to control the liquid jet device and/or a yarn product speed.

The apparatus may comprise winding apparatus disposed downstream of the liquid jet device. The apparatus may comprise cooling apparatus. The cooling apparatus may comprise the liquid jet device. The apparatus may also comprise heating apparatus, which may be disposed upstream of the cooling apparatus. The fluid jet device may be adapted to twist the yarn.

The jet device may be disposed downstream of a further cooling arrangement. The further cooling arrangement may be a fluid cooling arrangement in which the yarn product passes through a fluid to be cooled by heat transfer thereto. The further cooling arrangement may comprise a cooling chamber having a fluid inlet and a fluid outlet for cooling fluid to be passed therethrough, and a yarn product inlet and yarn product outlet. The cooling fluid may be passed in contraflow relative to the yarn product. The cooling chamber may comprise seals against escape of cooling fluid at the yarn product inlet and the yarn product outlet. The seals may be labyrinth seals, which may be pressurised, and may be gas pressurised, may be by compressed air. The cooling fluid may be a liquid and may be water. The flow of liquid through the cooling chamber may be arranged to be turbulent. The jet device and the further cooling arrangement may be contiguous. The jet device and the further cooling arrangement may have a common liquid.

BRIEF DESCRIPTION OF THE DRAWINGS

The invention will now be described with reference to the accompanying drawings in which.

DETAILED DESCRIPTION OF THE PREFERRED EMBODIMENTS

Figure 1:
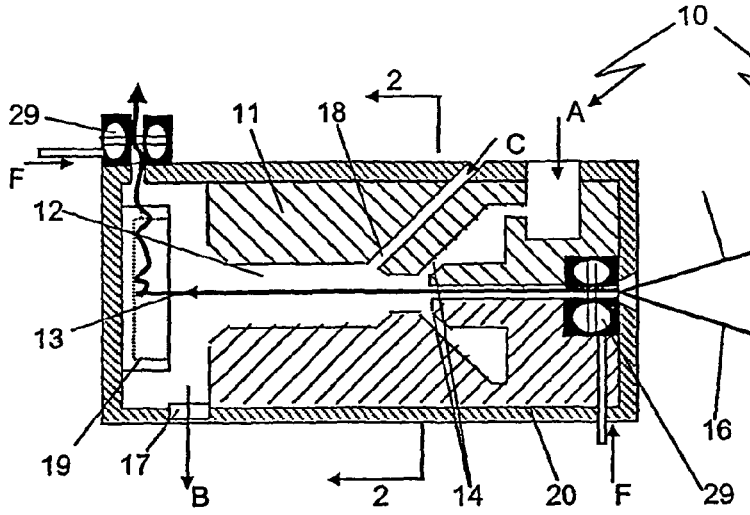
FIG. 1 is a longitudinal section on the line 1—1 of FIG. 2 of a first embodiment of liquid jet device.
Figure 2:
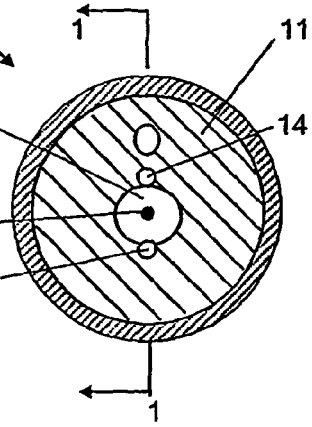
FIG. 2 is a section on the line 2—2 of FIG. 1.

Referring now to FIGS. 1 and 2, there is shown a liquid jet device 10 in the form of a cylindrical body 11 having a texturing chamber 12 defining an axial path for the yarn product 13 to pass through the jet 10. Opening into the texturing chamber 12 are inlets 14, two being shown in this case disposed around the yarn 13, for water or other suitable liquid provided from a source (not shown) in the direction of arrow A. The openings of the inlets 14 are transverse to the axis of the texturing chamber 12 so that the impinging jets of water are transverse to the running yarn product 13 and subject the yarn product 13 to an agitating force. The yarn product 13 is formed, in this case, by intermingling the filaments of a core yarn 15 and an effect yarn 16. The inlets 14 are directed at an angle to the direction of running of the yarn product 13 so that the water jets have components of velocity axially of the yarn product 13 as well as transversely thereof. This applies a forwarding force to the yarn product 13 as well as the transverse force. Alternatively the inlets 14 could be inclined in the reverse direction to apply a retarding force to the yarn product 13. The supply of water to the inlets 14 may be pulsed to produce a more even form of texturing or other desired effect. The body 11 is contained in a housing 20. The water exits from the texturing chamber 12 through an outlet 17 in the direction of arrow B, the flow of water from the yarn inlet and outlet ends of the housing 20 being prevented by labyrinth seals 29. The seals 29 are pressurised by gas, e.g. compressed air, fed in the direction of arrows F. Within the texturing chamber 12, and downstream of the water inlets 14, the water stream travelling with the yarn 13 passes an air inlet 18. This flow of water past air inlet 18 causes air to be drawn into the jet 10 in the direction of arrow C to be entrained by the water in the chamber 12, and thereby to increase the turbulence of the flow of the high pressure water/air mixture. On reaching the outlet 17, the yarn 13 impinges on a baffle 19, which provides a retardation of the yarn to increase the texturing effect.

Figure 3:
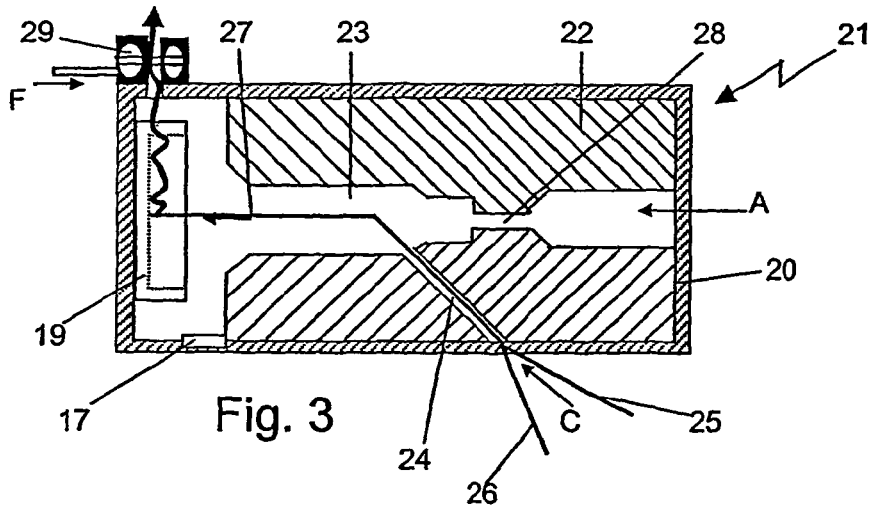
FIG. 3 is a section of an alternative embodiment of liquid jet device.

Referring now to FIG. 3, there is shown an alternative embodiment of liquid jet device 21. The jet device 21 has a body 22 in which there is a texturing chamber 23. A yarn inlet bore 24 communicates with the texturing chamber 23, and, as shown in this case, a core yarn 25 and effect yarn 26 are introduced into the jet device 21 through the inlet bore 24. The yarns 25, 26 enter the texturing chamber 23 where they are combined and textured by a jet of water impinging on them from a water jet inlet 28, thereby forming a yarn product 27. In this case air is entrained along the yarn inlet 24 by the flow of water into the texturing chamber 23, i.e. the force is applied to the yarn 27 by the liquid simultaneously with the liquid passing the yarn and air inlet 24. In both embodiments of jet device 10, 21 described above, depending on the geometry of the water inlets 14, 28 relative to the axis of the texturing chamber 12, 23, i.e. offset therefrom, the water jet or jets may twist the yarn.

Figure 4:
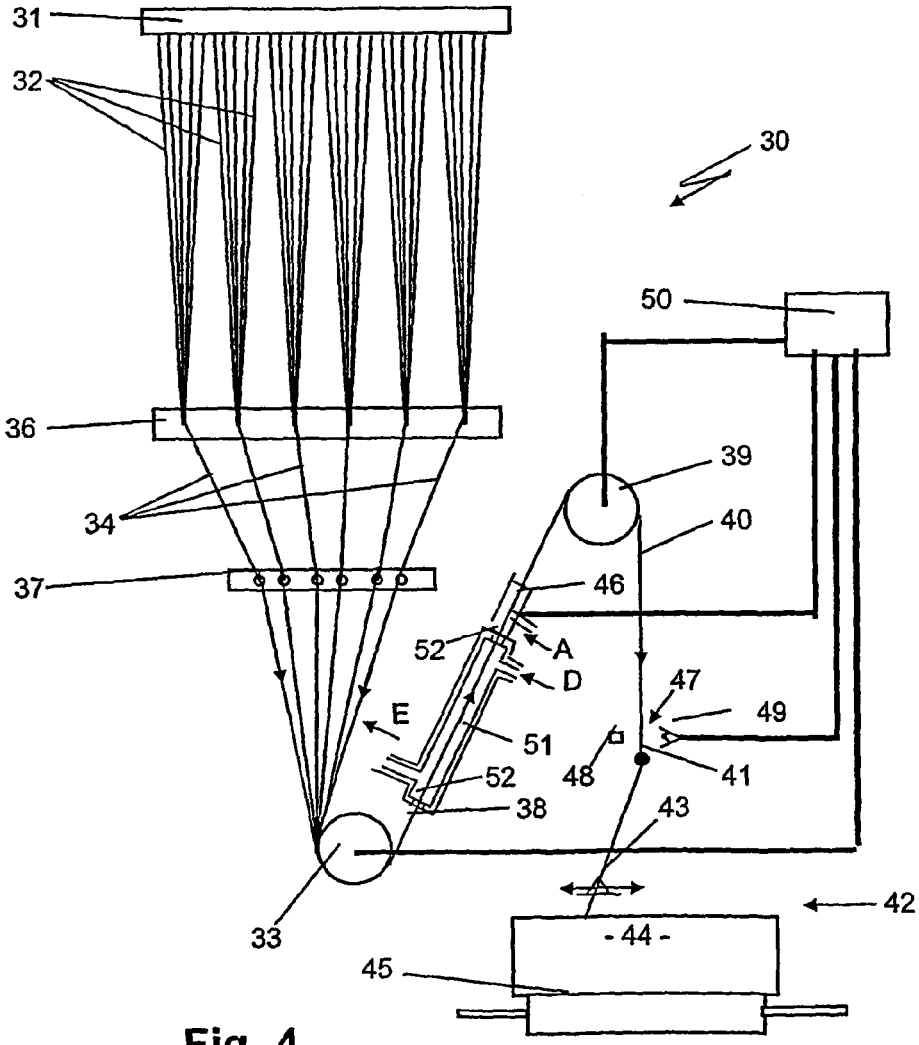
FIGS. 4 and 5 are threadline diagrams of alternative filament spinning apparatus incorporating the liquid jet device of FIGS. 1 and 2 or FIG. 3.

Referring now to FIG. 4, there is shown a filament spinning apparatus 30 having a spinning head 31 from which filaments 32 are extruded. The filaments 32 are withdrawn from the spinning head 31 by a first feed roller 33. Spin finish oil is applied to the filaments 32 by an oil applicator 36, at which the filaments 32 are brought together to form yarns 34, and the regularity of the oil application is improved by oil dispersion jets 37. The yarns 34 are drawn between the spinning head 31 and the first feed roller 33, and the resulting partially oriented yarn 38 is forwarded to a second feed roller 39. A liquid intermingling jet 46, which directs a jet of liquid at the yarn 38 to intermingle the filaments of the yarn 38, is disposed in the controlled tension zone between the first and second feed rollers 33, 39, but may be placed before the roller 33. The interlaced yarn 40 is passed through an optical interlace sensor 47 to a forwarding point 41. The interlaced partially drawn yarn 40 is then fed from the forwarding point 41 to a take up zone 42 to be wound using a traverse guide 43 onto a package 44 driven by surface contact with a driving bowl 45. The traverse guide 43 reciprocates as shown along a path parallel with the axis of the package 44. The interlace sensor 47 comprises an optical transmitter 48 and an optical receiver 49, a beam from the transmitter 48 being directed at the yarn 40 and then being received by the receiver 49. The receiver 49 sends to a control device 50 a signal, which varies in response to the changes in dimension of the intermingled yarn 40, i.e. as interlace nodes pass the sensor 48. The control device 50 is operable to control the supply and/or pressure of liquid to the intermingling jet 46 and/or the speed of the feed rollers 33, 39, and that supply may be pulsed if desired.

Figure 5:
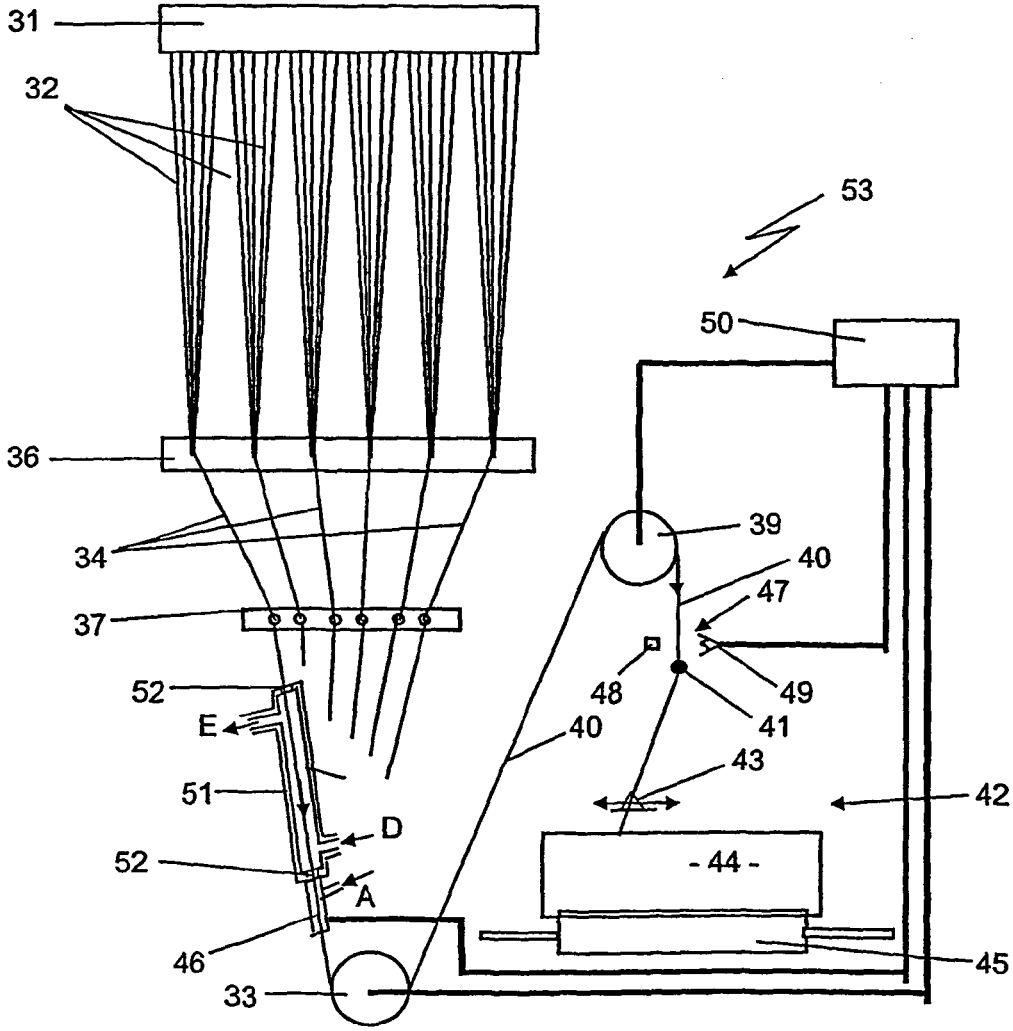

In the case of this invention, the intermingling jet 46 is constructed and operates as the device 10 of FIGS. 1 and 2 or 21 of FIG. 3, with water being introduced into the intermingling jet 46 in the direction of arrow A as described above and air being entrained into the texturing chamber of the jet 46 as described above. Conventionally, the distance between the spinning head 31 and the first feed roller 33, the cooling chimney, is a relatively long so that the yarns 34 have cooled to a temperature at which they can be subjected to the intermingling step in the jet 46. However, since the water and air entering the jet 46 are cold, thereby cooling the drawn yarn 38, this may provide sufficient cooling for a significant reduction in the height of the cooling chimney whilst allowing the satisfactory intermingling of the filaments of the yarn 38 by the jet 46. Alternatively, a further cooling device 51 may be placed in the threadline between the feed roller 33 and the intermingling jet 46. The cooling device 51 is a cylinder through which the yarn 38 passes and into which cooling water is introduced in the direction of arrow D and from which the water exits in the direction of arrow E. With this arrangement, the cooling water passes along the cooling device 51 in turbulent contraflow to the running yarn 38, both of which factors enhance the heat transfer from the yarn 38 to the cooling water. At the opposed ends of the cooling device 51, the yarn inlet and yarn outlet are provided with labyrinth seals 52 which can be pressurised against escape of water therethrough. The intermingling jet 46 and the cooling device 51 are shown as contiguous, and the cooling water may pass directly from one to the other. As a further alternative, as shown in machine 53 in FIG. 5, and provided that the tension in the yarns 34 is not too great, the cooling device 51 and intermingling jet 46 may be disposed between the oil dispersion jets 37 and the first feed roller 33 to further reduce the height of the cooling chimney. Only one of the yarns 34 is shown passing through the respective cooling device 51 and intermingling jet 46, for clarity.

Figure 6:
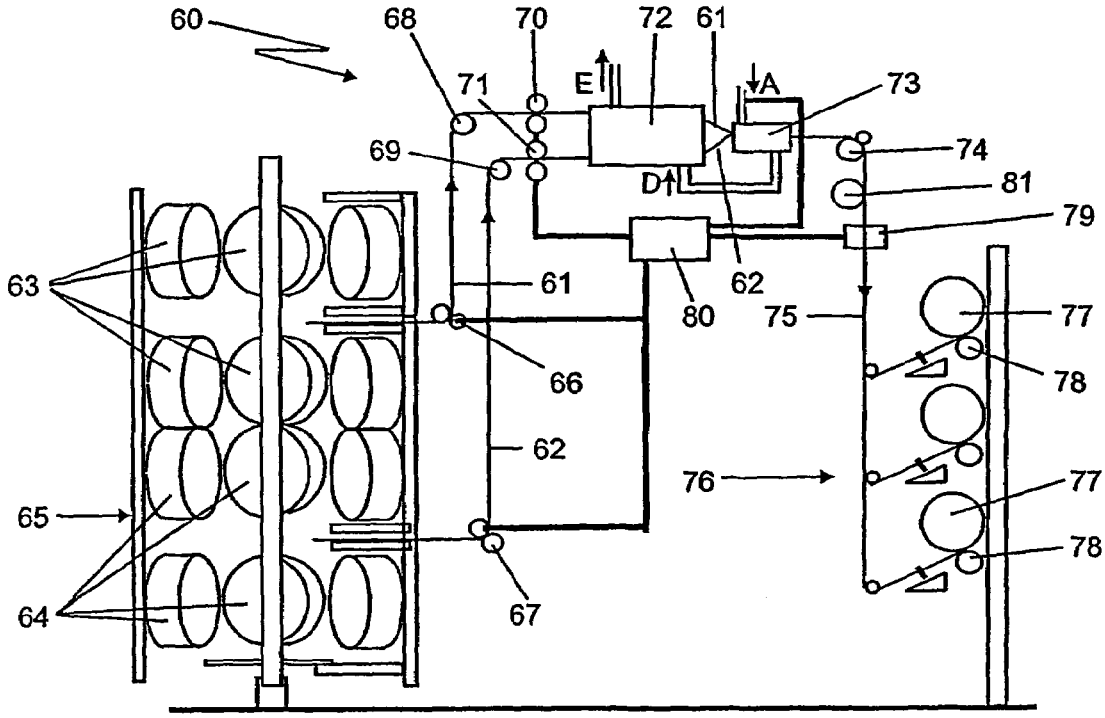
FIG. 6 is a yarn co-mingling machine incorporating the liquid jet device of FIGS. 1 and 2 or FIG. 3.

A machine 60 for co-mingling two or more yarns is shown in FIG. 6, in this case two textile yarns 61, 62. The yarns 61, 62, which may be the same as, but are more usually different from, each other, for example one may be a staple yarn, are supplied on respective supply packages 63, 64 mounted in a creel 65. The yarns 61, 62 are withdrawn from the packages 63, 64 by first feed roller pairs 66, 67 and fed along parallel tracks to respective heated rollers or draw pins 68, 69 to respective draw rollers 70, 71 and to a cooling device 72. From the cooling device 72 the yarns 61, 62 pass through a co-mingling device 73 to a second feed roller pair 74. The co-mingling device 73 is constructed and operates as jet device 10 of FIGS. 1 and 2 or jet device 21 of FIG. 3. The peripheral speed of the draw rollers 70, 71 is greater than that of the first feed rollers 66, 67 so that the yarns 61, 62 are drawn at the draw rollers or pins 68, 69, and the peripheral speed of the second feed rollers 74 is controlled relative to that of the draw rollers 70, 71 so that the tension in the yarns 61, 62 is controlled for satisfactory co-mingling of the yarns 61, 62. The yarns 61, 62 may be drawn to differing amounts, or one of the yarns may be forwarded directly from the feed rollers 66, 67 to the co-mingling device 73 so as not to be heated, drawn and cooled, as required in any particular application. Also either or both of the yarns 61, 62 may be false twisted, for example one S-twist and one Z-twist, between the feed rollers 66, 67 and the co-mingling device 73. The co-mingling device 73 agitates the yarns 61, 62 to co-mingle their filaments together to form a single coherent yarn 75. The heated rollers 68, 69 heat the yarns 61, 62 to facilitate the drawing step and any false twisting step. The thus co-mingled yarn 75 is forwarded to a take up arrangement 76 in which it is wound onto a bobbin 77 driven by surface contact with a driving bowl 78.

In this machine arrangement, the cooling device 72 and the co-mingling device 73 are shown to be contiguous. In addition, the water introduced into the co-mingling device 73 is forwarded therefrom to the cooling device 72 in the direction of arrow D, so that both devices 73, 72 use the same water. Also in the case of machine 60, there is shown a measuring instrument 79, which measures a property of the co-mingled yarn 75. Such parameter may be node frequency or coherence. The measuring instrument 79 sends a signal proportional to the value of the measured parameter to a controller 80 which compares that value with a predetermined desired value. If there is a discrepancy between the two values the controller 80 is operable to control the rate or pressure of water flow to the co-mingling device 73 and/or the speed of the first feed rollers 66, 67, the draw rollers 70, 71, and the second feed rollers 74.

By means of the invention improved texturing and intermingling are achieved by comparison with processing with air jet devices. In particular, in the case of intermingling core and effect yarns together, the core yarn provides most of the strength of the resultant textured yarn. In the present process, the core yarn is not opened or deviated as much as with the known processes, possibly due to the surface tension of the water. Although the core yarn is opened sufficiently for the effect yarn to be threaded through the core yarn and so be intermingled efficiently, it is not opened to the extent that the strength of the core yarn is seriously reduced. It has been found that air texturing produces strengths of 30–36 cN/tex, whereas strengths of 41.5 cN/tex can be produced with water/air texturing as described herein. In addition lower core overfeeds can be used in the present process, e.g. 2.9% instead of 5% to 8% with air jet texturing, to further improve the situation. These advantages are particularly important in the sewing thread market. For sewing threads, tight loops are required so as to minimise snagging and reduce needle temperatures during sewing. To achieve tighter such loops the textured yarn 75 may be heat set by passing the textured yarn 75 around a heated roll 81 as shown in FIG. 6. In the case of the present invention, such heat setting may enhance this property of the yarn 75 compared with that produced with air textured yarn, possibly as a result of "steaming" of the yarn during this heat setting step due to its higher water content.

The invention claimed is:

1. A method of texturing yarn products wherein a yarn product is passed along a predetermined yarn path through a housing with a yarn outlet, the method comprising:

providing a housing with a yarn inlet and a yarn outlet, the yarn path passing through the housing and including a predetermined section within a texturing chamber defined by a body within the housing between a texturing chamber inlet end and a texturing chamber outlet end, the texturing chamber outlet end being spaced from the housing yarn outlet; and, applying a force to the yarn transversely to the axis thereof in the texturing chamber by directing a liquid at said yarn as it passes through the texturing chamber, the predetermined section of the yarn path passing an air inlet to entrain air in liquid in the chamber.

2. The method according to claim 1, wherein the force is applied to the yarn by the liquid prior to the yarn passing the air inlet.

3. The method according to claim 1, wherein the force is applied to the yarn by the liquid simultaneously with passing the air inlet.

4. The method according to claim 1, wherein said directed liquid applies a forwarding force to the yarn product.

5. The method according to claim 1, wherein said directed liquid applies a retarding force to the yarn product.

6. The method according to claim 4, wherein a plurality of jets of liquid are directed at the yarn from the jets disposed about the yarn path through the texturing chamber.

7. The method according to claim 6, comprising applying the plurality of jets of liquid offset from the axis of the yarn path to twist the yarn product.

8. The method according to claim 1, wherein the liquid is water.

9. The method according to claim 8, wherein the water is cold water for yarn cooling.

10. The method according to claim 8, wherein the supply of water is pulsed.

11. The method according to claim 1, comprising directing the air entrained along the air inlet transversely to the axis of the direction of flow of liquid through the jet device.

12. The method according to claim 11, comprising directing the air entrained along the air inlet with components of velocity both axially of and transversely to the flow of liquid through the jet device.

13. The method according to claim 1, in which the yarn product is a plurality of yarns which are co-mingled to form a coherent yarn.

14. The method according to claim 13, wherein one of the yarns is a staple yarn.

15. The method according to claim 1, in which the yarn product comprises continuous filaments.

16. Apparatus for texturing yarn comprising:

a housing with a yarn inlet and a yarn outlet defining a yarn path therebetween;

a body within the housing defining a texturing chamber with a yarn inlet end and a yarn outlet end, and a yarn inlet thereto aligned with the yarn inlet to the housing; a liquid inlet to the body for directing a jet of liquid at yarn in said yarn path and in said body;

an inlet for air to be entrained in liquid in the texturing chamber; and, an outlet for discharge of liquid from the housing, wherein the outlet end of the texturing chamber is spaced from the housing yarn outlet and from the discharge liquid outlet from the housing.

17. The apparatus according to claim 16, wherein the liquid inlet is upstream of the air inlet.

18. The apparatus according to claim 16, wherein the liquid inlet is adjacent the air inlet.

19. The apparatus according to claim 16, wherein the liquid inlet is adapted to apply a forwarding force to the travelling yarn product.

20. The apparatus according to claim 16, wherein the liquid inlet is adapted to apply a retarding force to the travelling yarn product.

21. The apparatus according to claim 16, wherein a plurality of liquid inlets are disposed about the yarn path through the texturing chamber.

22. The apparatus according to claim 21, wherein the jets are offset from the axis of the yarn path to twist the yarn product.

23. The apparatus according to claim 16, comprising a housing which terminates in a yarn constricting outlet, having an axis defining a yarn path therethrough, with liquid flow channels aimed towards the outlet and transverse to the axis.

24. The apparatus according to claim 23, wherein the housing comprises at least one seal against liquid escape along the yarn path.

25. The apparatus according to claim 24, wherein the seal is a labyrinth seal.

26. The apparatus according to claim 25, wherein the seal is pressurised.

27. The apparatus according to claim 26, wherein the seal is gas pressurised.

28. The apparatus according to claim 27, wherein the seal is pressurised by compressed air.

29. The apparatus according to claim 16, wherein the air inlet extends transversely to the axis of the direction of flow of liquid through the jet device.

30. The apparatus according to claim 16, wherein the air inlet extends in a direction having components both axially of and transversely to the direction of flow of liquid through the jet device.

31. The apparatus according to claim 16, comprising a baffle located at the outlet of the jet device.

32. The apparatus according to claim 16, wherein the liquid inlet is connected to a source of water under pressure.

33. The apparatus according to claim 32, wherein the liquid inlet is arranged in said path of a plurality of yarns.

34. The apparatus according to claim 33, wherein the liquid inlet is arranged in a filament spinning apparatus.

35. The apparatus according to claim 32, comprising drawing means for drawing the yarn.

36. The apparatus according to claim 32, comprising a feedback arrangement operable to control the processing of the yarn product.

37. The apparatus according to claim 36, wherein the feedback arrangement comprises a measuring instrument operable to measure a property of the yarn product, and control means operable in response to a signal from the measuring instrument proportional to the measurement to control the processing of the yarn product.

38. The apparatus according to claim 37, wherein the control means is operable to control the liquid jet device.

39. The apparatus according to claim 37, wherein the control means is operable to control a yarn product speed.

40. The apparatus according to claim 32, comprising winding apparatus disposed downstream of the liquid jet device.

41. The apparatus according to claim 32, comprising cooling apparatus for cooling the yarn.

42. The apparatus according to claim 41, wherein the cooling apparatus uses liquid previously directed at the yarn.

43. The apparatus according to claim 41, also comprising heating apparatus for heating the yarn.

44. The apparatus according to claim 43, wherein the heating apparatus is disposed upstream of the cooling apparatus.

45. The apparatus according to claim 44, wherein the liquid inlet is adapted to direct water to twist the yarn product.

46. The apparatus according to claim 41, wherein the liquid inlet is disposed downstream of a further cooling arrangement.

47. The apparatus according to claim 46, wherein the further cooling arrangement is a fluid cooling arrangement in which the yarn product passes through a fluid to be cooled by heat transfer thereto.

48. The apparatus according to claim 47, wherein the further cooling arrangement comprises a cooling chamber with a fluid inlet and a fluid outlet for cooling fluid to be passed therethrough, and a yarn product inlet and yarn product outlet.

49. The apparatus according to claim 48, wherein the cooling fluid is passed in contraflow relative to the yarn product.

50. The apparatus according to claim 48, wherein the chamber comprises seals against escape of cooling fluid at the yarn inlet and the yarn outlet.

51. The apparatus according to claim 50, wherein the seals are labyrinth seals.

52. The apparatus according to claim 51, wherein the seals are pressurised.

53. The apparatus according to claim 52, wherein the seals are gas pressurised.

54. The apparatus according to claim 53, wherein the seals are pressurised by compressed air.

55. The apparatus according to claim 47, wherein the cooling fluid is a liquid.

56. The apparatus according to claim 55, wherein the cooling fluid is water.

57. The apparatus according to claim 55, wherein the flow of liquid through the chamber is arranged to be turbulent.

58. The apparatus according to claim 55, wherein the liquid jet device and the cooling arrangement are contiguous.

59. The apparatus according to claim 58, wherein the liquid jet device and the cooling arrangement have a common liquid.

* * * * *